United States Patent [19]

Apple

[11] Patent Number: 4,928,718

[45] Date of Patent: May 29, 1990

[54] UMBRELLA

[75] Inventor: Phillip C. Apple, Mt. Pleasant Mills, Pa.

[73] Assignee: American Holtzkraft, Inc., Mt. Pleasant Mills, Pa.

[21] Appl. No.: 386,436

[22] Filed: Jul. 28, 1989

Related U.S. Application Data

[63] Continuation-in-part of Ser. No. 237,432, Aug. 8, 1988, abandoned.

[51] Int. Cl.[5] ..... A45B 25/14; A45B 25/16

[52] U.S. Cl. ..... 135/22; 135/20 M

[58] Field of Search ..... 135/22, 20 M, 98

[56] References Cited

U.S. PATENT DOCUMENTS

| | | | |
|---|---|---|---|
| 686,347 | 11/1901 | Schoenberg et al. | 135/22 |
| 1,070,894 | 8/1913 | Hopkins | 135/22 |
| 1,145,310 | 7/1915 | Hole | 135/22 |
| 1,642,336 | 9/1927 | Friedrichs | 135/22 |
| 2,496,769 | 2/1950 | Battle | 135/20 M |
| 2,721,569 | 10/1955 | Militano | 135/20 M |
| 2,782,795 | 2/1957 | Small | 135/20 M |
| 3,129,715 | 4/1964 | Militano et al. | 135/20 M |
| 3,150,671 | 9/1964 | Frey | 135/20 M |
| 3,672,381 | 6/1972 | Kida et al. | 135/22 |
| 4,319,600 | 3/1982 | Roche | 135/20 M |
| 4,424,824 | 1/1984 | Becher | 135/20 M |
| 4,534,374 | 8/1985 | Day | 135/22 |
| 4,567,907 | 2/1986 | Dubinsky | 135/20 M |
| 4,582,078 | 4/1986 | Ma | 135/20 M |
| 4,807,655 | 2/1989 | Robertson | 135/20 M |

*Primary Examiner*—David A. Scherbel
*Assistant Examiner*—Caroline D. Dennison
*Attorney, Agent, or Firm*—Thomas Hooker

[57] ABSTRACT

An automatic umbrella includes a central post, a canopy assembly, and a spring and linkage mechanism which causes the umbrella to open when desired. There is also commonly a feature used for securing the umbrella in the closed position.

8 Claims, 3 Drawing Sheets

UMBRELLA

This is a continuation-in-part of application Ser. No. 237,432, filed on Aug. 8, 1988, abandoned.

FIELD OF THE INVENTION

This invention relates to automatically-opening umbrellas, particularly those heavier units suited for patio and recreational furniture use.

BRIEF DESCRIPTION OF THE PRIOR ART

Automatically-opening umbrellas are activated by a spring mechanism internal or external to a central post. The spring acts through a rigid linkage or direct attachment to open the umbrella and spread the canopy over the area to be protected.

When the spring mechanism is external to the post, there is a risk of injury to the user as well as a risk of damage to the mechanism. The bulk of an external mechanism required to raise a large patio or casual furniture umbrella could render its use impractical.

Internally-sprung designs rely on a longitudinal slot in the post which allows and directs the travel of a spring-connecting link. Along with the risk of operator injury this design incorporates additional friction and decreases the integrity of the central post.

SUMMARY OF THE INVENTION

The umbrella of the present invention has a central post surrounding an interior spring which is stressed when the umbrella is closed. The spring is fixed to the lower end of the hollow post. The upper end of the spring is attached to a pair of strands, both of which extend up through the interior of the post, pass around pulleys mounted on the top of the post and then extend down the outside of the post to a sliding hub. The sliding hub travels along a section of the post.

The umbrella canopy is supported by a plurality of ribs pivotally mounted to the top of the post above the pulleys. Struts support the frame ribs and pivotally interconnect the ribs and the sliding hub. The spring tensions the strands and pulls the the sliding hub up along the post to raise the struts and push the ribs up to open the umbrella. The spring is sufficiently tensioned to automatically raise the hub and open the umbrella. In some cases, with a very large umbrella having a heavy canopy, it may be necessary to lift the hub upward during opening.

The umbrella is readily collapsed by pulling the hub downwardly to lower the ribs and recompress the spring. The canopy is held in the collapsed position by an exterior tie surrounding the lower portion of the ribs and preventing the spring from opening the umbrella.

Other objects and features of the invention will become apparent as the description proceeds, especially when taken in conjunction with the accompanying drawings illustrating the invention, of which there are three sheets and one embodiment.

DESCRIPTION OF THE PREFERRED EMBODIMENT

Figure 1:
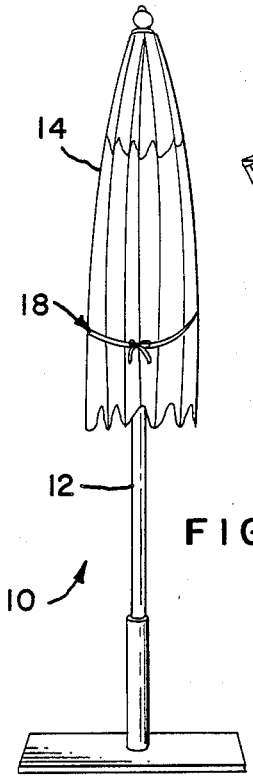
FIG. 1 is a perspective view of the umbrella in its closed position, showing the canopy tie.
Figure 2:
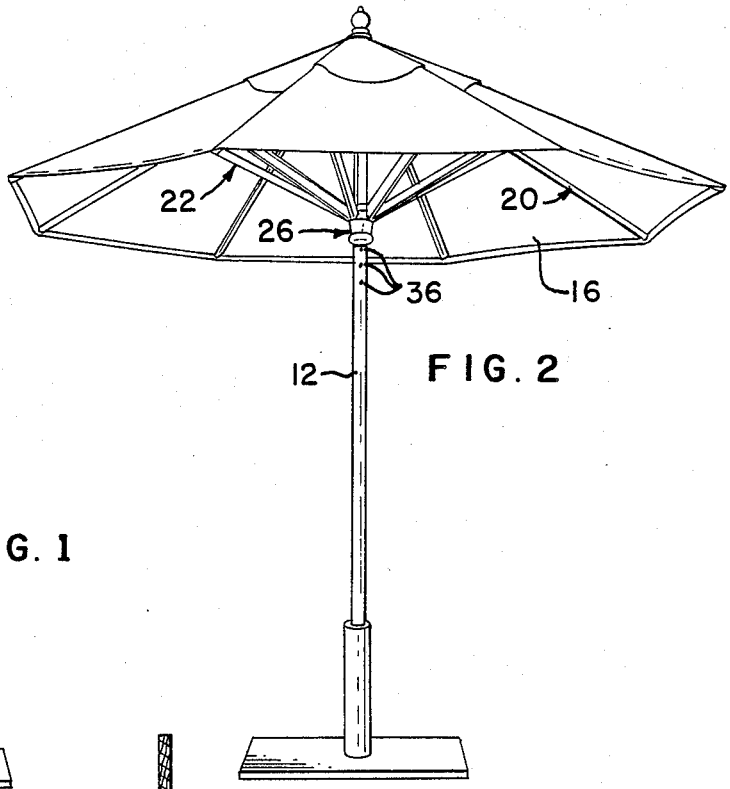
FIG. 2 is a perspective view of the umbrella in its opened position.
Figure 5:
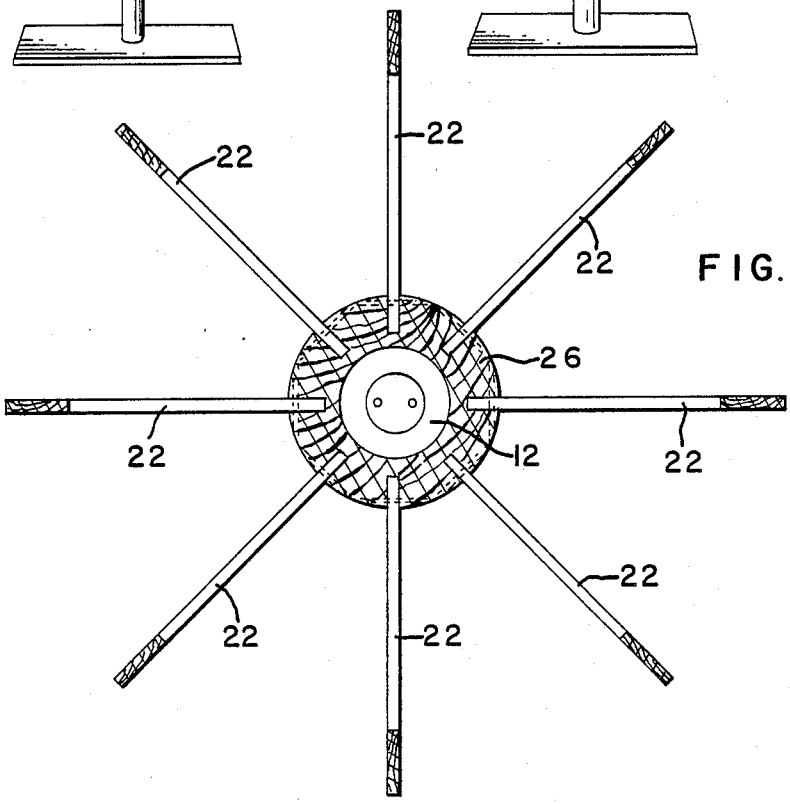
FIG. 5 is a sectional view taken along line 5—5 of FIG. 4.
Figure 3:
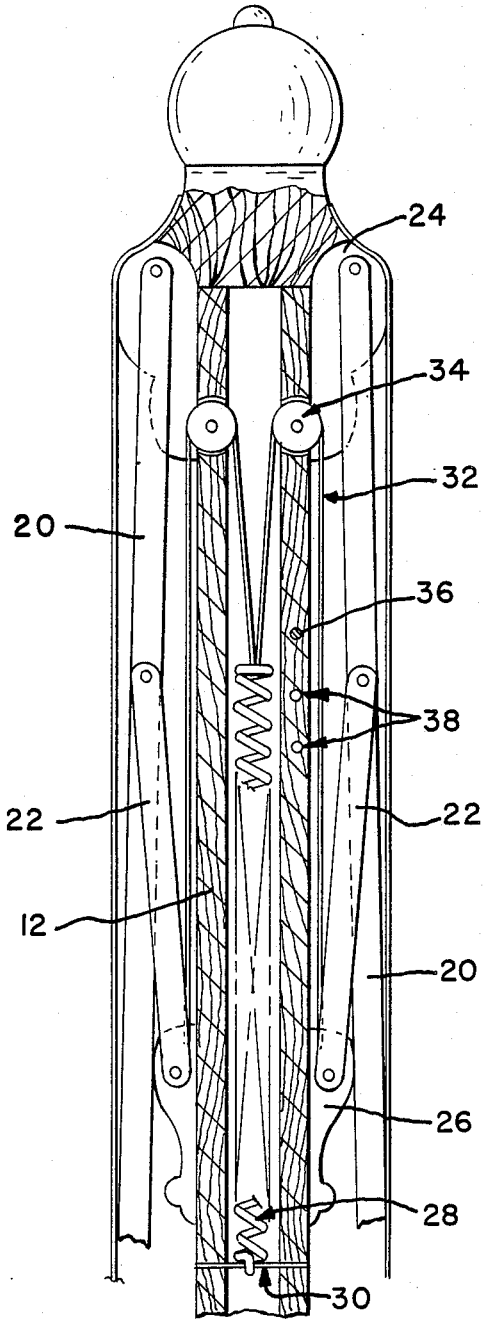
FIG. 3 is a detailed sectional view taken longitudinally through the central post, showing the spring and strand mechanism, with the umbrella closed.
Figure 4:
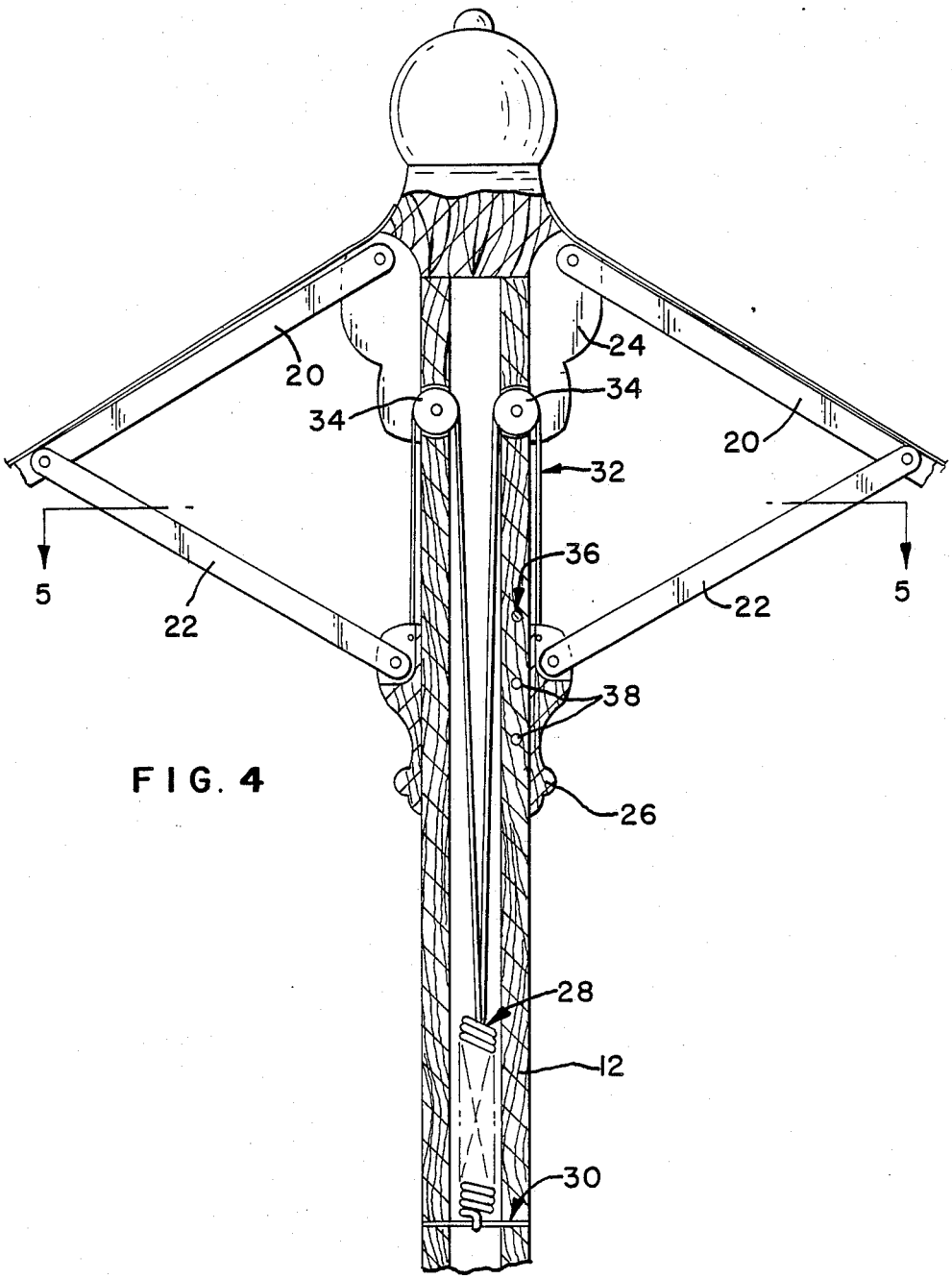
FIG. 4 is a view like FIG. 3, but with the umbrella opened.

Umbrella 10 includes hollow wooden post 12, and a canopy assembly 14 mounted on the post. The assembly includes a fabric canopy 16 and a rigid framework of ribs 20 and struts 22. The canopy fabric is attached to the ribs to provide shade and protection when opened. Wooden hub 26 surrounds post 10 and is freely slidable along the post. The inner ends of the struts 22 are pivotally connected to the hub and the outer ends of the struts are pivotally connected to the ribs a short distance below the top of the post. The inner ends of the ribs are pivotally connected to the top of the post. The hub is movable on the post between a lower, retracted position shown in FIG. 3 where the ribs are drawn together and nearly parallel to the post and the umbrella canopy is collapsed, and an extended position shown in FIG. 4 where the hub is raised higher along the post and the ribs are opened to spread the canopy. The canopy includes a loose fabric tie 18 with may be tied around the outside of lower portion of the canopy when collapsed to hold the umbrella in the closed position. See FIG. 1.

Spring 28 is confined within the central cavity of hollow post 10. The lower end of the coil spring is attached to an anchor pin 30. The upper end of the spring is secured to a pair of strands 32. The strands extend up the inside of the post and pass over pulleys 34 mounted on opposite sides of the top of the post. From the pulleys 34 the strands extend downwardly on opposite sides of the outside of the post and are suitably secured to opposite sides of hub 26. The use of two, opposed strands to connect the spring to the hub balances forces applied to the hub to prevent twisting and binding of the hub on the post during opening and closing of the umbrella. When the umbrella is closed, as in FIG. 3, the spring and strands are under load. Removing the tie allows the umbrella to open through relaxation of the spring and consequent motion of the strands around the pullies 34 which pull the sliding hub upward. This forces the stays 22 outward against the ribs 20, opening the umbrella. See FIG. 4.

Upward longitudinal travel of the sliding hub is limited by the position of a stop pin 36 which may be inserted in one of several stop pin holes 38 in post 12. This allows the user to choose the extent to which the umbrella is to be opened.

Outward tension against the shroud assembly is provided by spring 28, thus allowing for the use of rigid ribs and struts in the frame assembly. This in turn permits the use of relatively nonflexible frame materials since there is no requirement for these members to act as springs.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An umbrella including a central straight post, a plurality of ribs surrounding the post and pivotally connected to the upper end of the post, a sliding hub surrounding the post between the upper and lower ends of the post, a plurality of struts surrounding the post and having post ends pivotally connected to the hub and rib ends pivotally connected to the ribs so that moving the hub upwardly along the post opens the ribs, a canopy attached to the ribs, a spring having a lower end fixed to the lower end of the post, a pulley mounted on the upper end of the post and a first strand having a first end attached to the upper end of the spring, a second end attached to the hub and a central portion extending up from the upper end of the spring, around the pulley and down to the hub, an umbrella having a collapsed position where the canopy, ribs and struts are adjacent the post, the hub is located in an elevated position on the post and the spring is extended, and an open position where the ribs, struts and canopy are opened away from the post, the hub is located in a lowered position on the post and the spring is retracted.

2. An umbrella as in claim 1 wherein said post is hollow, said spring is confined within the center of the post, the portion of the strand extending between the spring and the pulley is within the post and the portion of the strand extending from the pulley to the hub is outside the post.

3. An umbrella as in claim 2 including a second pulley at the top of the post located across the post from the first pulley and a second strand having a first end attached to the upper end of the spring, a second end attached to the hub across from the second end of the first strand and a central portion extending up from the upper end of the spring, around the second pulley and down to the hub.

4. An umbrella as in claim 3 wherein said post is made of wood.

5. An umbrella including a straight post, a pulley at the upper end of the post, a plurality of ribs surrounding the post and pivotally connected to the upper end of the post, a canopy mounted on the ribs and opening means for moving the ribs between an open position away from the post where the canopy is extended and a closed position adjacent the post where the canopy is collapsed, said opening means including a hub slidably mounted on the post between the upper and lower ends of the post and a plurality of struts having ends pivotally connected to the hub and to the ribs, a coil spring having a lower end fixed to the lower end of the post, a pulley mounted on the upper end of the post above the hub, and a first strand having a first end attached to the upper end of the spring, a second end attached to the opening means and a length extending from the first end around the pulley and to the second end, an umbrella having a collapsed position where the canopy, ribs and struts are adjacent the post, the hub is located in an elevated position on the post and the spring is extended, and an open position where the ribs, struts and canopy are opened away from the post, and the hub is located in a lowered position on the post and the spring is retracted.

6. An umbrella as in claim 5 wherein the post is hollow, said spring and part of the first strand being confined within the interior of the post.

7. An umbrella as in claim 6 including a second pulley at the top of the post opposite the first pulley, and a second strand like said first strand extending up from the upper end of the spring, around the second pulley and down to the hub.

8. An umbrella as in claim 5 including stop means limiting movement of the hub up the post.

* * * * *

UNITED STATES PATENT AND TRADEMARK OFFICE

CERTIFICATE OF CORRECTION

PATENT NO. : 4,928,718

DATED : May 29, 1990

INVENTOR(S) : Phillip C. Apple

It is certified that error appears in the above-identified patent and that said Letters Patent is hereby corrected as shown below:

In the Claims:

Claim 1, column 3, line 14, change "an elevated" to --a lowered--; and line 17, change "a lowered" to --an elevated--.

Claim 5, Column 4, lines 19 and 20, change "an elevated" to --a lowered--; and line 23, change "a lowered" to --an elevated--.

Signed and Sealed this

First Day of October, 1991

*Attest:*

*Attesting Officer*

HARRY F. MANBECK, JR.

*Commissioner of Patents and Trademarks*